United States Patent [19]

Land

[11] 3,990,898

[45] Nov. 9, 1976

[54] IN-PROCESS COLOR BALANCE ADJUSTMENT OF PHOTOGRAPHIC FILM USING FILTER DYES

[75] Inventor: Edwin H. Land, Cambridge, Mass.

[73] Assignee: Polaroid Corporation, Cambridge, Mass.

[22] Filed: June 26, 1974

[21] Appl. No.: 483,090

[52] U.S. Cl. ..... 96/73; 96/3; 96/16; 96/74; 96/77; 96/84 R

[51] Int. Cl.[2] ..... G03C 1/76; G03C 1/40; G03C 7/00; G03C 1/84

[58] Field of Search ..... 96/84 R, 3, 73, 74, 96/77, 16, 21, 69; 117/34

[56] References Cited

UNITED STATES PATENTS

| | | | |
|---|---|---|---|
| 3,415,645 | 12/1968 | Land | 96/3 |
| 3,544,325 | 12/1970 | Depoorter et al. | 96/84 R |
| 3,672,898 | 6/1972 | Schwan et al. | 96/84 R |
| 3,819,376 | 6/1974 | Land | 96/16 |

*Primary Examiner*—David Klein
*Assistant Examiner*—Richard L. Schilling
*Attorney, Agent, or Firm*—Philip G. Kiely

[57] ABSTRACT

The color speeds of a multicolor photosensitive element are balanced during the manufacture thereof by continuously introducing into said element optical filter means adapted to modulate the photographic color speed of at least one of the selectively sensitized silver halide emulsions relative to the other(s), and then adjusting the density of said optical filter means during coating to an amount sufficient to obtain the desired color balance.

23 Claims, 12 Drawing Figures

IN-PROCESS COLOR BALANCE ADJUSTMENT OF PHOTOGRAPHIC FILM USING FILTER DYES

BACKGROUND OF THE INVENTION

1. Field of the Invention

This invention is concerned with photography and, more particularly, with the formation of multicolor photographic images.

2. Description of the Prior Art

It is well known that photographic films, and especially multicolor films, may and generally do vary sensitometrically from lot to lot, notwithstanding efforts to "repeat" previous films.

Equipment used to coat multicolor films is highly precise but variations between intended coverages of silver halide and/or the dye image-providing materials do occur. Repeat batches of silver halide emulsions may, and usually do, vary in their photographic response. Individual layers may be dried to slightly different degrees. Manufacturers of multicolor photographic films have thus developed a number of procedures to minimize the effects upon the final multicolor image of unavoidable variations in the manufacturing operations.

If the film is designed to be developed by a photofinisher or in a darkroom, processing of the exposed multicolor film may be controlled within very narrow limits in order to minimize sensitometric variations from film to film. Where the multicolor film is of the negative type, an opportunity to adjust the sensitometry occurs in printing the desired final positive image, during which operation the printing exposure may be appropriately color filtered, for example, by a "masking" technique.

Obviously the basic sources of sensitometric variations noted above also exist in multicolor diffusion transfer films, with the added complication that once the film is shipped, the sensitometric properties are essentially fixed. The opportunity for adjustment provided in darkroom processing, practically speaking, is unavailable for users of self-developing films. While professional and advanced amateur photographers may be skillful enough to utilize color correction filters to at least partially "rebalance" the color balance, ordinary users of the film would only be confused by such additional operations; more important, however, is the fact that the use of these color correction filters usually results in an undesirable reduction of the effective film speed.

Accordingly, if deviations in the intended sensitometry are discovered during the coating of the photosensitive material, for example, from tests on in-process inspection samples, immediate corrective action is very desirable in order to avoid coating a large amount of material which may not be acceptable or salvageable after the coating run has been completed. It is possible to make changes in the sensitometric characteristics of the resulting multicolor transfer image during coating by making changes in the coverages or ratios of the silver halide and/or dye image-providing materials. However, these changes in the essential image-forming components of the photosensitive element oftentimes result in quite complex and unpredictable changes in sensitometry and are likely to have an undesirable effect on sensitometric parameters other than the color balance, for example, transfer density, color saturation, processing temperature latitude, ageing and the like.

Furthermore, what may be an optimum ratio of components for color balance may not also be the optimum ratio for the other sensitometric parameters.

Prior to the present invention, light absorbing substances have been put to a variety of uses in photosensitive elements including, (a) filters in overcoatings to protect the light sensitive emulsion or emulsions from the action of light which it is not desired to record, e.g., ultraviolet light absorbers; (b) filters in layers arranged between emulsions of different color sensitivity to protect them from exposure to light of the wrong color, e.g., the well known yellow filter to protect red- and gree-sensitized emulsions from the action of blue light; (c) filters in backing layers forming the so-called "antihalation" layers on either side of a transparent support carrying the light-sensitive emulsion or emulsions; (d) spectral correction filters which selectively absorb light of undesired wavelength, e.g., integral masking filters and filters employed for obtaining acceptable color rendition upon exposure to a variety of illuminants such as described in Schwan et al U.S. Pat. No. 3,672,898; and (e) "trimming" filters for reducing excess photographic speed, e.g., in the lower speed emulsion of a "doubly coated" emulsion designed to increase exposure latitude to light of a specified wavelength such as described in Wyskoff, U.S. Pat. No. 3,663,228.

More specifically, Beckett et al U.S. Pat. No. 3,547,640 disclose the incorporation of at least one nondiffusing, nonbleachable, nonimage-recording colored material in the support layer, or in one or more hydrophilic colloid layers of the photographic element through which light passes when the developed color reproduction is viewed or used to expose other color elements such as color positive materials, In Beckett, the incorporated filter material must remain with the viewed image to compensate for any image dye deficiencies in minimum density areas of the color reproduction without appreciably affecting the color balance in the other portions of the sensitometric curve. In contrast with Beckett, the filter material of the present invention is not present in the viewed image, which is formed by diffusion transfer in a distal location relative to the layer in which the filter material was introduced.

As previously indicated, filters have also been heretofore incorporated in upper layers of a photographic element through which light must pass to expose lower lightsensitive layers. For example, Higgins et al U.S. Pat. No. 2,697,036 employs such light-absorbing materials in a multilayer color photographic film to reduce light-scattering effects of turbid upper layers during exposure and then removes the filter material during processing. Land U.S. Pat. No. 2,966,408 describes the use of a nontransferable pigment e.g., a yellow dye, in the outermost layer of the photosensitive element to reduce excess photographic speed in a silver diffusion transfer process, thereby eliminating the necessity of a light filter before the camera lens.

In most processes described above, the density of any incorporated filter is set prior to coating at a specified value which is predetermined by the expected photographic properties of a particular emulsion. If unexpected variations in sensitometry are discovered during coating, the process is usually either shut down for modification of coating coverages or the deviate material is continued to be coated and salvaged later by other techniques.

The present invention is directed to correcting the unexpected sensitometric variations which may be discovered during the coating of the photosensitive element, and provides this correction without significantly interrupting the coating process or the predetermined relationships between the image-forming components.

BRIEF SUMMARY OF THE INVENTION

In accordance with this invention, the color balance of a multicolor photosensitive element having coated on one surface of a support a plurality of layers including at least two silver halide emulsions of different spectral sensitivities is conveniently "corrected" or adjusted during the manufacture thereof by continuously introducing into the element optical filter means adapted to modulate the photographic color speed of at least one of the silver halide emulsions relative to the color speed of the other emulsion(s) to provide a color balance which is a function of the optical density of the filter, and then adjusting the density of the filter during said introduction to an amount sufficient to obtain a different predetermined color balance. The selectively sensitized silver halide emulsions of the photosensitive element preferably each have associated therewith an image-providing material exhibiting complementary spectral absorption characteristics.

The invention is especially useful in connection with the manufacture of photosensitive elements employed to form diffusion transfer color images, particularly those employing dye developers as the dye image-providing materials. In a preferred embodiment, the optical filter means is a filter dye whose effective optical density may be adjusted by varying the coverage of dye introduced into the element during coating. In elements employing dye developers, the dye moiety thereof provides a particularly advantageous filter dye for modulating the color speed of its associated silver halide emulsion in accordance with the invention. The location of the filter material(s) in the photosensitive element and the amount and light absorption properties of the filter material(s) employed will depend in large part on the sensitometric effects desired, as will be later discussed in more detail.

BRIEF DESCRIPTION OF THE DRAWINGS

For a fuller understanding of the nature and objects of the invention, reference should be had to the following detailed description taken in connection with the accompanying drawings wherein.

Figure 1:
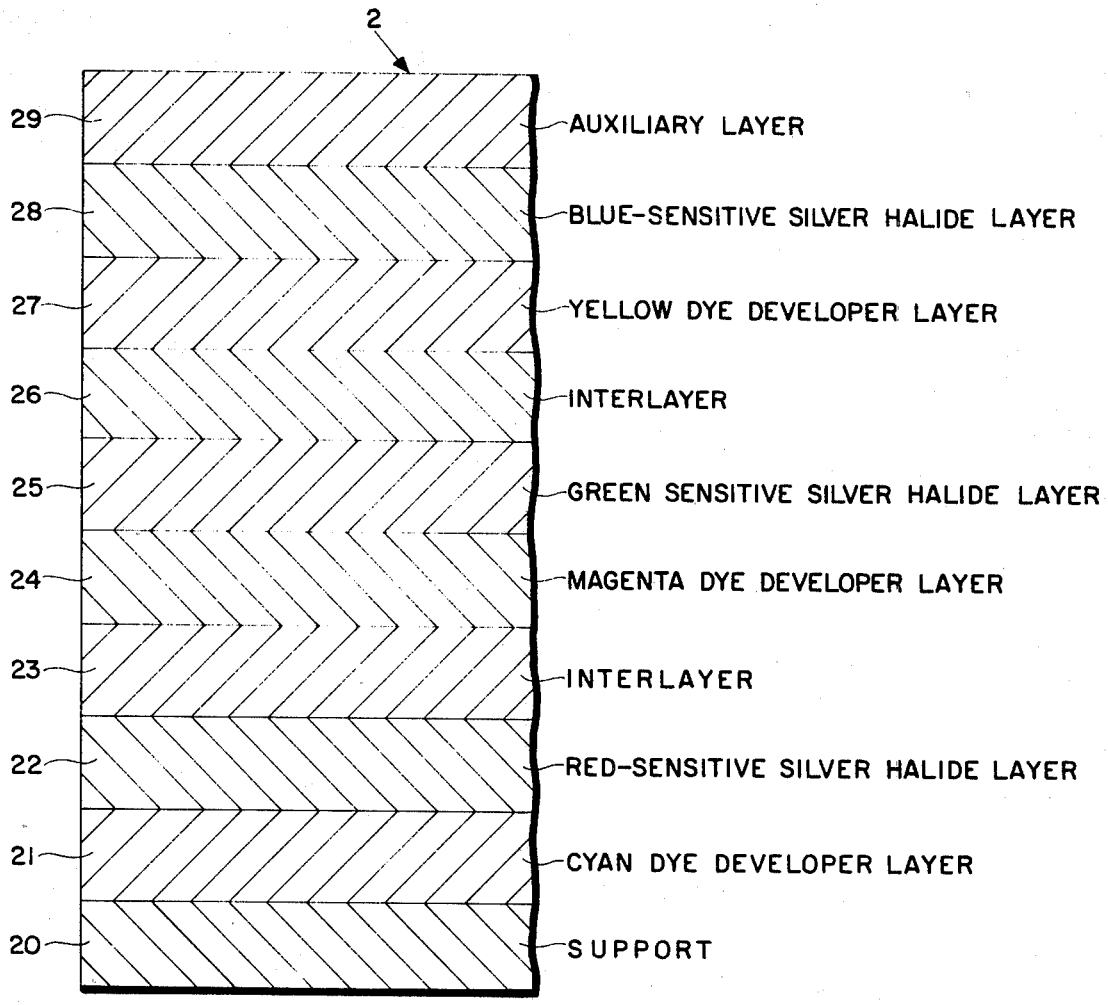
FIG. 1 is a diagrammatic enlarged cross-sectional view illustrating a multicolor diffusion transfer photosensitive element with which the present invention is useful, the thickness of the various layers shown being exaggerated.
Figure 2A:
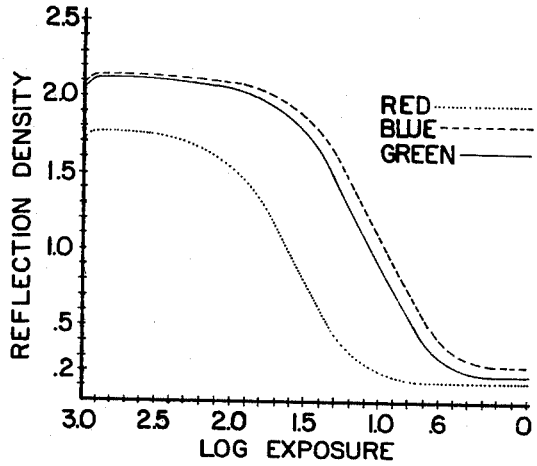
Figure 2B:
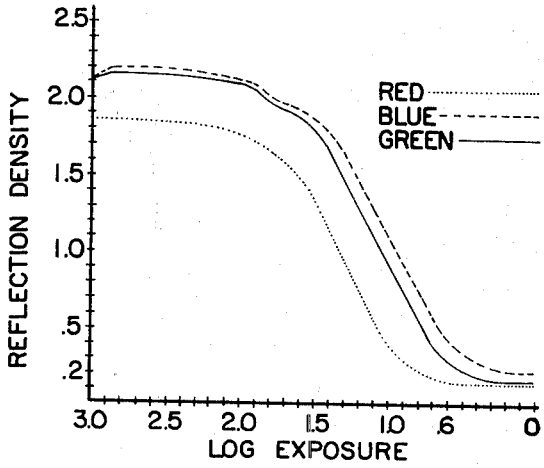
Figure 2C:
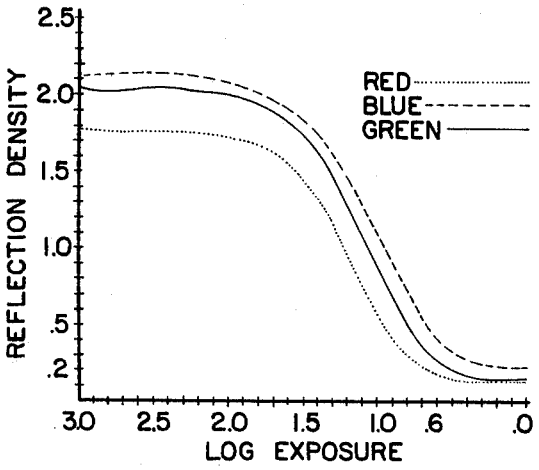
Figure 2D:
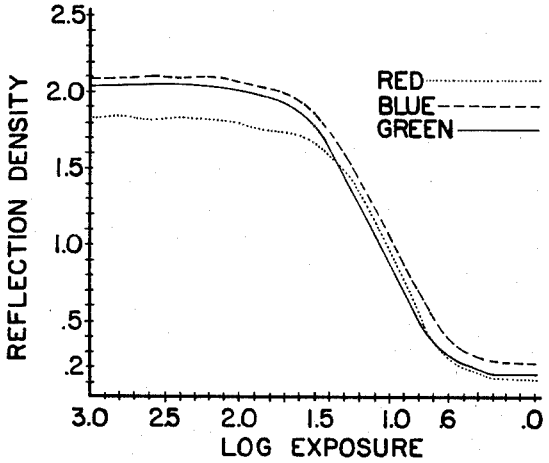
Figure 3A:
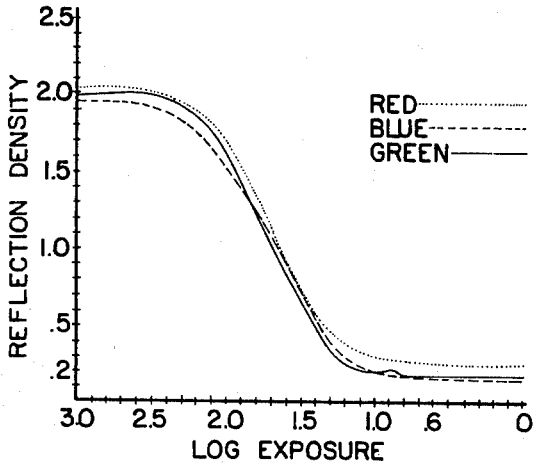
Figure 3B:
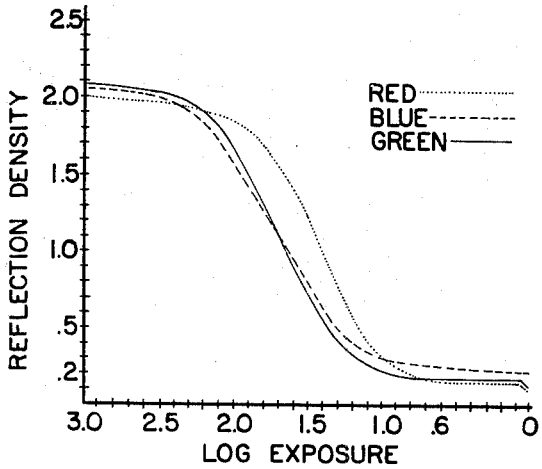
Figure 3C:
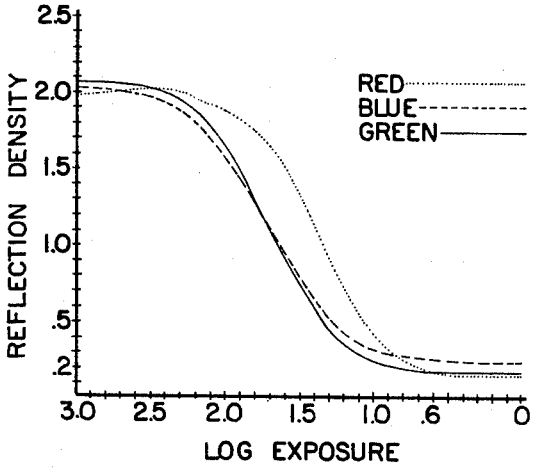
Figure 3D:
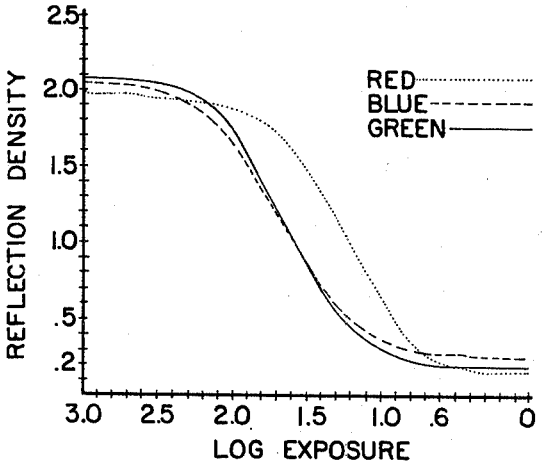

FIGS. *2a–2d* are D log E curves obtained from the positive transfer image reflection densities provided by various coverages of cyan filter dye in the magenta dye developer layer of a photosensitive element such as illustrated in FIG. 1;

FIGS. *3a–3d* are D log E curves obtained from such photosensitive elements having various coverages of cyan filter dye in the red-sensitive silver halide emulsion layer; and FIGS. *4a–4c* are D log E curves obtained from such photosensitive elements having various coverages of yellow filter dye in an auxiliary overcoat layer.

DETAILED DESCRIPTION OF THE PREFERRED EMBODIMENT

The present invention is considered useful with any photographic material having at least two selectively sensitized silver halide emulsions coated on a support and employed to record multicolor images. As noted above, the present invention has special applicability to multicolor diffusion transfer films and, for convenience, the following illustrative description will be in connection with such films, although the invention in its broadest aspects is not limited thereto.

Diffusion transfer films are well known in the art and need not be described in great detail here. Generally speaking, such films rely for color image formation upon a differential in mobility or solubility of a dye image-providing material obtained as a function of development of exposed silver halide so as to provide an imagewise distribution of such material which is more diffusible and which is, therefore, selectively transferred, at least in part, by diffusion, to a superposed dyeable stratum to impart thereto the desired color transfer image. The differential in mobility or solubility may, for example, be obtained by a chemical action such as a redox reaction or a coupling reaction.

In any of these systems, multicolor images are obtained by employing a photosensitive element containing at least two silver halide emulsions of different spectral sensitivities each having associated therewith a dye image-providing material exhibiting complementary spectral absorption characteristics. The most commonly employed elements of this type are the so-called tripack structures employing a blue-, a green- and a red-sensitive silver halide layer having associated therewith, respectively, a yellow, a magenta and a cyan dye image-providing material.

A particularly useful system for forming color images by diffusion transfer is that described in U.S. Pat. No. 2,983,606, employing dye developers (dyes which are also silver halide developing agents) as the dye image-providing materials. In such systems, a photosensitive element comprising at least one silver halide layer having a dye developer associated therewith (in the same or in an adjacent layer) is developed by applying an aqueous alkaline processing composition. Exposed and developable silver halide is developed and associated dye developer is oxidized to provide an oxidation product which is appreciably less diffusible than the unoxidized dye developer, thereby providing an imagewise distribution of diffusible dye developer in terms of undeveloped areas of the silver halide layer, which imagewise distribution is then transferred, at least in part, by diffusion to an image-receiving stratum layer to impart thereto a positive dye transfer image. Multicolor images may be obtained with a photosensitive element having two or more selectively sensitized silver halide emulsions and associated dye developers. A tripack structure of the type described above is especially suitable for accurate color recordation of the original subject matter.

Specifically, with reference to FIG. 1, the multicolor, multilayer photosensitive element 2 may comprise a support 20 carrying a red-sensitive silver halide emulsion layer 22, a green-sensitive silver halide emulsion layer 25 and a blue-sensitive silver halide emulsion layer 28. In turn, the emulsion layers may have positioned behind them and contained in layers 21, 24 and 27, respectively, a cyan dye developer, a magenta dye developer and a yellow dye developer. Interlayers 26 and 23 may be respectively positioned between the yellow dye developer layer and the greensensitive emulsion layer, and between the magenta dye developer layer and the red-sensitive emulsion layer. An auxiliary or overcoat layer 29 may also be included as the outermost surface of the photosensitive element.

The multicolor image resulting from diffusion transfer processing of the photosensitive element may be revealed by separation of the image-receiving element from the photosensitive element subsequent to processing and image transfer, although processes are heretofore known wherein the aforementioned elements are retained in superposition and the image is viewed through a transparent support.

Illustrative of patents describing color diffusion transfer products and processes are the aforementioned Rogers U.S. Pat. No. 2,983,606 issued Mar. 9, 1961; Yutzy U.S. Pat. No. 2,756,142 issued July 24, 1956; Rogers U.S. Pat. No. 3,087,817 issued Apr. 20, 1963; Weyerts U.S. Pat. No. 3,146,102 issued Aug. 25, 1964; Whitmore U.S. Pat. No. 3,227,552 issued Aug. 27, 1964; Barr et al U.S. Pat. Nos. 3,227,551 and 3,227,554 issued Jan. 4, 1966; Whitmore et al U.S. Pat. No. 3,337,550 issued Jan. 4, 1966; Barr U.S. Pat. No. 3,243,294 issued Mar. 29, 1966; Land U.s. Pat. Nos. 3,415,644, 3,415,645 and 3,415,646 issued Dec. 10, 1968; Rogers U.S. Pat. Nos. 3,594,164 and 3,594,165 issued July 20, 1971; and Land U.S. Pat. No. 3,647,347 issued Mar. 7, 1972.

The color characteristics and qualities of the positive transfer image may be, and conventionally are, expressed in terms of the H and D (Hurter and Driffield) or D log E curve. As is well understood in the photographic art, the D log E curve graphically presents the relationship of the recorded image density to the exposure required to obtain said density. In the case of the subject positive D log E curve, the curve is a plot of increasing reflection densities along a vertical axis against decreasing values of the logarithm of the exposure providing this measured density along a horizontal axis. Such curves may be readily plotted for diffusion transfer multicolor positive images, in a known manner, the maximum transfer density being a measure of the minimum exposure received by the silver halide and the lowest transfer density being a measure of the maximum exposure received by the silver halide. Customarily, the portion of minimum densities ($D_{min}$) of the D log E curve is referred to as the "toe" portion, and the portion of the curve reproducing maximum densities ($D_{max}$) is referred to as the "shoulder" portion. The portion of the D log E curve between the shoulder and the toe over which the gradient or "slope" of the curve is substantially constant, customarily referred to as the "straightline" portion, is a measure of the exposure range over which the density is proportional to log E. The sensitometric slope is usually taken on this straight line portion between two fixed density intercepts to the line, for example, between 1.05 density units and 0.55 density units. The "shape" of the curve is dependent on complex interrelationships between the above parameters and refers to the actual configuration of the curve.

With the tripack arrangement shown in FIG. 1, separate D log E curves may be plotted for each of the blue-, green- and red-sensitive emulsions. In this regard, the terms "red", "green" and "blue" are employed in a broad technical sense to represent a division of the visible spectrum into three substantially equal wavelength regions of about 100 nm each, i.e., the red region from about 600 to 700 nm, the green region from about 500 to 600 nm and the blue region from about 400 to 500 nm. It is understood that references to red-, green- and blue-sensitive emulsions are not to be interpreted as sensitivites to these specific wavelengths alone, but represent broad divisions of the visible spectrum which may overlap to some degree or may be extended to include, for example, at least some ultraviolet or infrared sensitivity.

Photographic "speed" is a parameter derived from the D log E curve which correlates with the effective sensitivity or photoresponse of the photographic emulsion to exposure from light of specified wavelengths. "Red speed" relates to the sensitivity of the red-sensitive silver halide emulsion to red light and is derived from the red D log E curve. Corresponding meanings are given for "green speed" and "blue speed" as respectively derived from the green and blue D log E curves. Although several methods have been employed to derive the speed parameter from the D log E curve, it has been convenient in multicolor diffusion transfer films to employ what may be termed the "fixed density" method whereby speed is determined to be the log E value (on the horizontal axis) read from the curve at the intercept of a specified positive transfer density value (on the vertical axis) which falls within the straight line portion of the curve, e.g., a value such as 0.75 density units. All other parameters being equal, the D log E curves of emulsions having different speeds will differ only in their relative locations along the log E (horizontal) axis. This relationship is illustrated, for example, by the relative movement of the red curve in FIGS. 2a-2d and FIGS. 3*a*–3*d* and the relative movement of the blue curve in FIGS. 4*a*–4*c*. It is not necessary that the individual curves overlap; indeed, it may be desirable that the curves be of similar shape, but spaced apart (i.e., with different speeds) by a predetermined amount, as will be discussed in more detail later in connection with color balance. In practice, the densities commonly employed to plot the subject D log E curves are known as "integral densities". These densities are called "integral" because they measure the total density at a given wavelength independent of the dye or dyes responsible for that density.

The relationship between the speeds of the individual color D log E curves is herein referred to as the "color balance" or more specifically, color speed balance. Although the term color balance has sometimes been used in the art to designate the curve relationships in terms of parameters other than speed, e.g., curve shape or slope, the term as used herein is intended to be given a more limited meaning which designates the above-described relationship of color speeds. "Reading" the relative speeds from the blue, green and red D log E curves and determining color balance provides one means of indicating the color quality of the resultant transfer image. For a color film to reproduce colors approximately as the eye sees them, its responses to red, green and blue parts of white light (i.e., its color speeds) must bear approximately the same relation to each other as do the responses of the eye to these same colors. For example, if the film has relatively too much sensitivity to red light (i.e., red speed too high relative to green and blue speed), red objects in the scene will appear much too light in the color reproduction, assuming correct exposure for green and blue objects and white or lightly colored objects such as light skin tone will appear reddish. The extent of this color imbalance may be graphically depicted by the relative positions of the individual color curves along the log E axis and a quantitative determination of the imbalance may be obtained from a color balance calculation based on relative color speeds. It has been found convenient in the multicolor diffusion transfer elements being discussed to derive a numerical representation of color balance from the D log E curves by considering the green speed as the reference point and then to express the color balance as two numbers; the first representing the algebraic difference between the red and green speeds, and the second representing the algebraic different between the blue and green speeds. A positive value indicates a higher speed relative to the green speed (and that the color balance is shifted in the direction of that color), whereas a negative value designates a lower speed relative to the green speed (and that the color balance is shifted in the direction of its subtractively complementary color).

Successful process control during the coating of a photosensitive element requires, first of all, that the process conditions known to produce satisfactory results be specified as completely as possible in terms of variables to which the resultant picture is sensitive. Then, reference or aim values for these variables are attempted to be reproduced from run to run. The variables include, for example, the concentrations or coverages (weight per unit of area) of the active solution constituents as well as physical parameters such as temperatures and flow rates. After this point, further manipulation of the process has as an objective the minimizing of all departures from the aim values. Control of the photographic coating process is frequently accomplished by a feedback mechanism wherein inspection samples are taken during coating, analyzed and compared to the aim values using standard sensitometric procedures. Analysis of the color balance of these samples as discussed above is a particularly valuable indicator of the picture quality to be expected in the final product. As previously indicated, if unexpected departures from the aim color balance are indicated by the in-process samples, immediate corrective measures are highly desirable during coating in order to avoid the manufacture of a large amount of material which may not be acceptable or which may not be salvageable after coating. The incorporation of an adjustable density optical filter in accordance with the present invention provides an extremely effective and convenient means for the in-process correction of the color balance of the photosensitive element.

The spectral absorption maxima of the filter material used in this invention preferably coincide or differ very slightly from the sensitization maxima of the silver halide emulsion for which the filter is used, and thus the filter material is specifically adapted to modulate the photographic speed of that emulsion in relation to the speed(s) of the other silver halide emulsion(s). Accordingly, the color balance as previously defined is made a function of the optical density of the filter material introduced and desirable changes in color balance may be readily effected by changing the optical density of the filter material during the coating operation, e.g., by introducing more or less of the filter material into the element.

It will be readily apparent to those skilled in the art that the aim color balance value should be one which includes a certain amount of filter material in the photosensitive element. This allows for the speed of the associated emulsion to be increased (by taking out some filter material) as well as to be decreased (by putting in more filter material).

The use of color filters to control the exposure of silver halide emulsions in a conventional sense is well understood in the photographic art and thus the basic principles to be applied in the present invention will be apparent to those skilled in the art given the present disclosure. For example, it will be apparent that a cyan colored filter material should be introduced into the element in association with a red-sensitive silver halide emulsion since a cyan filter attenuates red light; similarly, a magenta colored filter material would be desirably associated with a greensensitive silver halide emulsion and a yellow colored filter with a blue-sensitive silver halide emulsion. Selection of the color of filter material or materials employed would depend on the color sensitivy of the emulsion or emulsions for which speeds must be adjusted to produce the desired color balance. It will also be apparent that the degree of attenuation accomplished by the filter material will be a function of the optical density of the filter, e.g., the concentration or "coverage" of a filter dye, and that this degree of attenuation is in turn dependent on the speed of the emulsion and how far the D log E curve must be shifted to achieve the desired color balance. The correlation between the density of filter material and resulting color balance shift may be readily calculated and plotted by coating a series of different densities of the selected filter material in an otherwise unchanged photosensitive element and determining the corresponding color balance changes which result. One need only then look to, for example, a graph or table derived from these results to determine the change in filter density required for a desired color balance shift.

A wide variety of appropriately colored filter dyes are known and available in the art and are contemplated as being useful in the present invention to provide the optical filter. For example, as a general reference see Venkataraman Synthetic Dyes, Academic Press, New York (1952). Ideally, the dye selected should absorb light in only the approximately one-third of the visible spectrum to which the associated silver halide is sensitized, while transmitting the remaining two-thirds of the visible spectrum. For example, the red-sensitive silver halide emulsion would have associated therewith a cyan filter in accordance with this invention, which filter would ideally absorb only red light to modulate the red speed while transmitting green and blue light so that the green and blue speeds remain relatively unchanged. The selected filter material must also be chemically and photographically compatible with the other components of the photosensitive element and system. If the color image is retained in the photosensitive element with the filter material, for example, as is the case for non-diffusion transfer negative processes, the filter dye should be able to be removed or otherwise disposed of by suitable means since these dyes could interfere with the viewing and printing of the recorded image. In the preferred diffusion transfer elements, the filter dye employed must be substantially non-diffusible from its initial location in the photosensitive element, especially during diffusion transfer processing, and must not interfere with the formation or viewing of the transfer image, i.e., it must be nonimageforming. To meet the immobility requirement, the selected filter material should be substantially insoluble in an aqueous alkaline environment.

In diffusion transfer elements employing dye developers, the dye moiety of the dye developer associated with the silver halide emulsion whose speed is to be modulated may serve as a particularly advantageous source of filter material for use according to this invention. In dye developers, as discussed in detail in the aforementioned patents, the cyan, magenta and yellow image-forming dyes are attached to silver halide developing radicals, for example, hydroquinone radicals, which act as the solubilizing moiety for the dyes in aqueous alkali. In the absence of the developer moiety, the remaining dyes are essentially insoluble and nondiffusible, and their light absorption and chemical properties are already especially tailored to the particular photosensitive element in which they are incorporated.

The dyes employed in this invention may be any of those suitable for the intended purpose and particularly those heretofore known for providing the dye moiety of the dye developers disclosed in the art, for example, in U.S. Pat. No. 2,983,606 and numerous other U.S. patents. As further examples of U.S. patents, incorporated by reference herein for detailing particularly preferred dye moieties suitable for the practice of this invention, mention may also be made of U.S. Pat. Nos. 3,563,739 and 3,551,406 (magenta dyes); U.S. Pat. Nos. 3,597,200 and 3,705,184 (yellow dyes); and U.S. Pat. No. 3,482,972 (cyan dyes).

The filter material of this invention may be incorporated in a variety of locations or combinations of locations in the photosensitive element. Preferably, it is incorporated in a layer or layers of the photosensitive element, e.g., the element illustrated in FIG. 1, through which light must pass to expose the associated emulsion and wherein it most effectively modulates the speed of the associated silver halide emulsion without adversely affecting other sensitometric parameters of the associated emulsion or the sensitometry of other emulsions. It will be apparent from observing spectral absorption curves of known dyes that most exhibit "tails" of absorption which extend into adjacent wavelengths of the spectrum and, while often approximating the ideal situation described above, usually absorb at least some of the light which should be transmitted. For this reason, it has been found that if one or more silver halide emulsions other than that associated with the incorporated filter material is located below the filter material in the photosensitive element, the speed of that emulsion may also be affected, although to a much lesser extent. Hence, controlled color balance adjustments may be accomplished employing one or more filter materials associated with the uppermost silver halide emulsion layers; however, the effect of the filtration on the lower emulsion or emulsions must be considered in determining what the final effect will be on the color balance.

As an example, referring again to FIG. 1, the red-sensitive silver halide emulsion layer 22 is shown to be the lowermost emulsion layer of the photosensitive element, as is preferably the case. To selectively move the color balance in accordance with this invention along the red axis, i.e., adjust the red speed only while the green speed and blue speed remain relatively constant with respect to one another, a cyan dye may be introduced into element 2 in association with the red-sensitive silver halide, e.g., at a location somewhere above the red-sensitive silver halide of layer 22 and preferably between layer 22 and the next adjacent silver halide, i.e., the green-sensitive silver halide of layer 25. Although the use of a cyan dye is preferable, it should be noted that blue light is absorbed when it reaches the yellow dye developer layer 27 and green light is absorbed by the magenta dye developer layer 24, so that essentially the only light reaching layer 22 is red light. For this reason, a neutral colored filter material may also be useful in a location between the green- and red-sensitive silver halide. Preferably, the filter material associated with the red-sensitive silver halide emulsion layer 22 is disposed in layer 22 itself, in the interlayer 23 or in magenta dye developer layer 24. Particularly advantageous results are obtained when the cyan dye is incorporated in the magneta dye developer layer.

It has been found that the sensitometric effect may vary with the location of the filter material. For example, if a cyan dye is included in the red-sensitive silver halide emulsion layer 22 in close relationship to the silver halide and other components of the emulsion, other parameters, e.g., the red slope, may be affected much more than if the cyan dye is included in a more remote location in a separate layer such as magenta dye developer layer 24. Introduction of the cyan dye into or above the greensensitive emulsion layer 25 is possible with the appreciation that the sensitometric parameters of the other emulsions, especially the speeds, may also be affected as described above. In the latter case, movement of the color balance may not only be along the red axis, but along the blue axis as well, with possible changes in the reference green speed.

Although the green speed is considered as the standard for color balance determination and thus theoretically need not be changed for color balance adjustment purposes, a magenta filter dye in association with the greensensitive emulsion layer may, of course, be employed if a green speed adjustment is desired. Frequently, magenta dyes exhibit varying amounts of red light absorption and therefore changes should also be expected in the red speeds. A yellow dye may also be incorporated in association with the blue-sensitive emulsion layer 28, e.g., in layer 28, or preferably in an auxiliary layer 29 to adjust blue speed in accordance with this invention, although again some effect may also be seen in green and red speeds, and particularly the green speed, because of the tail absoprtion of the yellow dye.

The invention is not limited to the use of only on filter material at a time. A number of techniques to adjust the color balance to the desired value are suggested by the use of one or more filter materials in the same photoesensitive element in accordance with the invention, alone or in combination with changes in other selected process variables. For example, simultaneous changes in the coverages of a cyan filter dye, yellow filter dye and the green-sensitive silver halide coverage in the same photosensitive element may be employed to shift the green speed as well as color balance in such a manner as to achieve the desired picture quality.

The filter materials of the present invention are incorporated during the coating of the photosensitive element as in-process control technique. "During introduction"and "in-process" in the appended claims denotes the variation in density of the filter material contemporaneous with any of the coating operations associated with the manufacture of the element. The amount of filter material continuously introduced will vary from the start to the finish of the coating operation depending on the optical density required to make the necessary color balance adjustments. Therefore, the present invention is to be distinguished from techniques wherein the color balance may be corrected by "overcoating" a previously manufactured photosensitive element with a layer containing the appropriate predetermined fixed density of filter material(s), or by including a predetermined fixed density of filter material in an existing layer of the photosensitive element to "trim" the expected excess speed of a particular emulsion, particularly the blue-sensitive emulsion, as described in the aforementioned Land U.S. Pat. No. 2,966,408.

The introduction of the filter materials of this invention into a layer of the photosensitive element may be accomplished in any of the manners customarily employed to continuously introduce coating addenda during coating. In coating multilayered photosensitive elements such as those presently being discussed, coating solutions are usually delivered from individual supply reservoirs to a coating head where they are applied to the support to form the respective layers. The delivery rates of these coating solutions are frequently individually metered to provide the desired coverage of each solution. In one advantageous method of introducing the filter material into a particular layer, the material may be first uniformly distributed in a suitable medium, e.g., a hydrophilic colloid such as gelatin, to form a coating solution which can be mixed with the coating solution forming the appropriate layer. The addition may be accomplished, for example, by mixing the required amount of filter material with the layer's coating solution in a supply reservoir prior to delivery to the coating head, or preferably by an in-line blending technique wherein the two coating solutions are intimately mixed during the delivery. The filter material is preferably individually metered from a separate supply to provide immediate and controlled adjustment of the amount of filter material introduced into the layer. In a preferred embodiment, the filter material added may comprise a waterinsoluble filter dye dispersed in solid form in a gelatin matrix by any suitable technique, e.g., colloid milling, sonification, homogenization, etc., possibly together with a small amount of dispersing agent or other coating aid. A convenient filter dye concentration in the dispersion has been found to be in the range of about 10% by weight.

The amount of a particular filter introduced will be dependent upon the degree of color balance change sought, as previously indicated. The coverages of filter material may vary from less than 1 mg. to over 20 mg. per square foot, with preferred coverages ranging from about 1 to 10 mg. per square foot. Higher coverages, for example, in the range of from about 20 mg. to 40 mg. per square foot or more are feasible, however, the attendant stronger absorptions, particularly the aforementioned tail absorptions, may become troublesome to control and some deviation may be exhibited from filtration-coverage relationships calculated at lower coverages (i.e., values may deviate from the linear relationship established by Beer's Law). Of course, whatever coverages found from routine experimentation to be effective for the color balance changes desired are suitable for the practice of this invention. As previously stated, it may be considered desirable to set the aim color balance at a value which represents a certain minimum coverage of the filter so that adjustments to color balance can be made in both positive and negative directions.

A typical coating run employing the in-process color balance control techniques of the present invention will produce an elongated strip of photosensitive material having a plurality of superposed layers coated longitudinally along one surface of a support from which individual photosensitive elements may be obtained for the fabrication of film units. The coated layers will comprise at least two silver halide emulsions of different spectral sensitivities and optical filter means adapted to modulate the photographic color speed of at leaat one of the silver halide emulsions relative to the speed of the other emulsion to provide a color balance which is a function of the density of the filter. The density of the filter, and thus the color balance, will vary along the length of the strip from the beginning to a point where the density is sufficient to provide the predetermined color balance, as in-process corrections are made in accordance with the invention, and thereafter the density will remain substantially constant. After coating the strip, that portion having the corrected color balance may be separated from the web and employed to fabricate film units without further adjustment. The remaining portion may be corrected by salvage techniques, e.g., overcoating with additional filter material needed to bring the color balance to that exhibited by the corrected portion, or individual photosensitive elements may be corrected in their respective film units, e.g,, by combining them with specially matched processing compositions in the film unit.

The implementation of this invention may be more readily understood if further description is made in the context of specific examples, which are presented for the purposes of illustration only and are not intended to limit the invention.

EXAMPLE I

A multilayer diffusion transfer photosensitive material of the type shown in FIG. 1 was prepared by coating, in succession, along one surface of a gelatin subbed, opaque film base, the following layer whose numbers correspond with those shown in FIG. 1:

21. a layer comprising the cyan dye developer

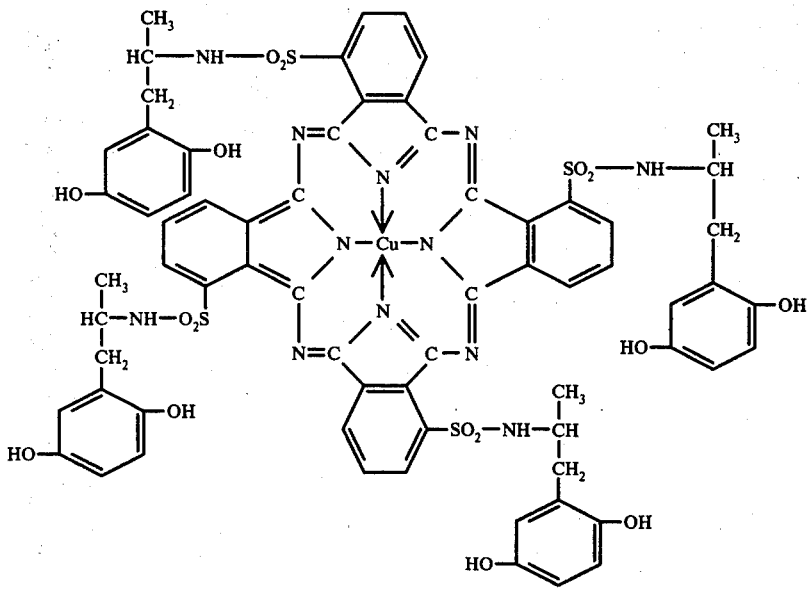

dispersed in gelatin;

22. a red-sensitive gelatino silver iodobromide emulsion layer;

23. an interlayer of a 60–30–4–6 copolymer of butylacrylate, diacetone acrylamide, styrene and methacrylic acid, plus about 2.4% by weight of polyacrylamide permeator;

24. a layer comprising the magenta dye developer:

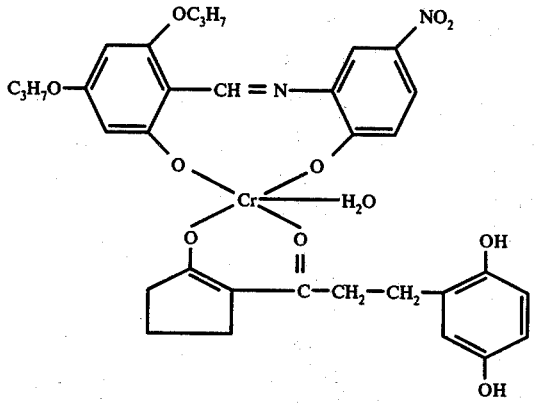

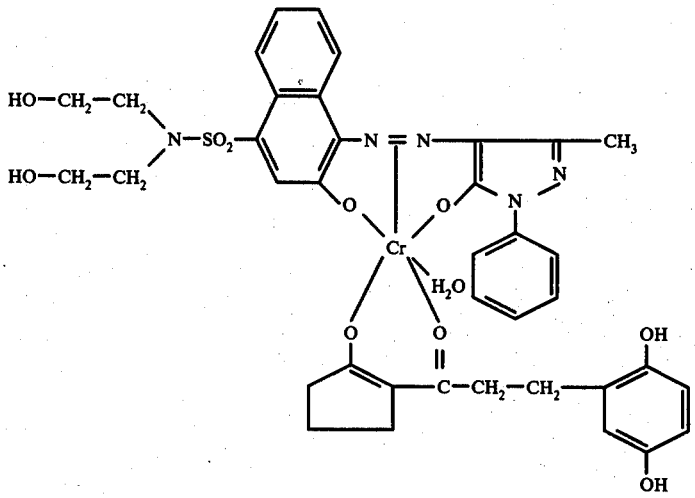

dispersed in gelatin;

25. a green-sensitive gelatino silver iodobromide emulsion layer;

26. a layer containing the copolymer referred to above in layer 23 plus about 7.8% polyacrylamide, and also containing succindialdehyde as a hardener;

27. a layer comprising the yellow dye developer:

dispersed in gelatin;

28. a blue-sensitive gelatino silver iodobromide emulsion layer also including 4'-methylphenylhydroquinone as an auxiliary developer;

29. a gelatin overcoat layer.

A portion of the above-described material was maintained unmodified for purposes of control. Second, third and fourth portions were modified by in-line blending a 10% solid dispersion of copper phthalocyanine dye in gelatin at coverages of 3 mgs./ft.$^2$, 6 mgs./ft.$^2$ and 9 mgs./ft.$^2$, respectively, into the coating solution forming the magenta dye developer layer 24. Copper phthalocyanine is essentially the cyan dye moiety of the cyan dye developer of layer 21, and is commercially available, for example, from American Cyanamid Company, Pigments Division, Bound Brook, N.J., 08805, under catalog No. 55–3297.

Immediately after coating, 24 hours after coating, and 6 days after coating, samples of the above-described portions were taken and photosensitive elements were fabricated therefrom. The elements were exposed in a sensitometer to a step wedge target and processed by spreading an alkaline diffusion transfer processing composition between the respective exposed photosensitive element and a superposed image-receiving element as they passed through a pair of pressureapplying rollers having a gap of about 0.0036 inches.

It should be recognized that further specific details of the components of the film units employed are not necessary for the purposes of the present illustration since these components were maintained constant throughout the comparison. The only essential difference in the film units tested was the respective coverages of the copper phthalocyanine dye in the magenta dye developer layer of the photosensitive element. While these matters need not herein be described in detail, it may be noted that the unmodified photosensitive element, image-receiving element and processing composition employed are substantially the same as previously described in several commonly assigned patents and applications for patent, for example, the copending application of Carlson et al, Ser. No. 420,134, filed Nov. 29, 1973.

After an imbibition time of about 60 seconds at room temperature (about 75° F.), the image-receiving element was separated and the integral reflection densities to red, green and blue light of a resultant neutral colored transfer image density wedge were measured by an automatic recording densitometer which plotted the characteristic positive D log E curves. FIGS. 2*a*–2*d* represent the D log E curves obtained for photosensitive elements containing 0 mg., 3 mgs., 6 mgs. and 9 mgs. of cyan dye per square foot, respectively, processed 24 hours after coating. Table 1 below summarizes the hereinbefore defined sensitometric parameters derived from the D log E curves (expressed in density units × 100):

By reviewing the D log E curves of FIGS. 2*a*–2*d* in association with the parameters of Table 1, it can be seen that the color balance of the control portion was initially very red (e.g., see high positive value for red color balance in Table 1) due to an inordinately high red speed relative to the green and blue speeds. This condition became progressively worse (more red) with the aging of the negative. However, it is shown that this imbalance could quite effectively be adjusted to more acceptable values through the introduction of various amounts of a cyan filter dye into the magenta dye developer layer in accordance with the teachings of this invention. A consideration of the changes in the relative position of the red curve in FIGS. 2*a*–2*d*, particularly in the straight-line portion, quite clearly illustrates the effect of the invention on the sensitometry of the photosensitive element and the selectiveness of adjustment which is possible. The general effect of the cyan filter may be calculated from this series of coatings to be approximately a 5 unit red color balance change per milligram of cyan filter coverage, with a slight change (3 units per milligram of cyan filter coverage) in red slope and what was considered insignificant changes in the green and blue parameters.

It can also be seen from Table 1 that the color balance of all of the elements shifted in the red direction with aging. Accordingly, the introduction of the cyan filter dye in accordance with this invention may also be employed as a valuable tool for adjusting the color balance based on immediate processing (e.g., as would be the case for inprocess inspection samples) so as to compensate for the change in color balance during storage. The method could result in a minimum of further adjustment by other techniques prior to the incorporation of the photosensitive element into the film unit, of the effects of aging were established to be the same from run to run. For example, if a red color balance of about +20 units were desired, the results indicated in Table 1 from immediate processing would dictate that about 3 mg. of cyan filter per square foot should be present in the magenta dye developer layer. However, with the knowledge that 6 days aging would result in an increase of about another 20 units to +40, one need only increase the coverage of cyan filter dye to about 6 mg. to compensate for this change and obtain the desired color balance of +20 after 6 days storage. A film unit fabricated and sold at this time could be expected to provide approximately this red color balance without further adjustment.

TABLE 1

| | $D_{max}$ | | | $D_{min}$ | | | Slope (1.05–0.55 portion) | | | Speed (.75 int) | | | Color Balance | |
|---|---|---|---|---|---|---|---|---|---|---|---|---|---|---|
| | R | G | B | R | G | B | R | G | B | R | G | B | R | B |
| Immediate processing | | | | | | | | | | | | | | |
| 0 mg./ft.$^2$ (control) | 176 | 212 | 215 | 11 | 17 | 23 | 168 | 160 | 173 | 144 | 92 | 81 | +52 | −11 |
| 3 mg./ft.$^2$ of cyan filter | 183 | 213 | 217 | 13 | 18 | 25 | 171 | 172 | 173 | 113 | 90 | 78 | +23 | −12 |
| 6 mg./ft.$^2$ of cyan filter | 184 | 207 | 215 | 14 | 18 | 25 | 182 | 172 | 174 | 101 | 92 | 80 | +9 | −12 |
| 9 mg./ft.$^2$ of cyan filter | 183 | 206 | 215 | 14 | 17 | 24 | 190 | 168 | 170 | 82 | 89 | 80 | −7 | −9 |
| Processing after 24 hrs | | | | | | | | | | | | | | |
| 0 mg./ft.$^2$ (control) | 181 | 216 | 218 | 12 | 18 | 24 | 177 | 168 | 173 | 146 | 89 | 78 | +57 | −11 |
| 3 mg./ft.$^2$ of cyan filter | 184 | 215 | 218 | 12 | 17 | 24 | 188 | 179 | 175 | 119 | 91 | 79 | +28 | −12 |
| 6 mg./ft.$^2$ of cyan filter | 186 | 208 | 215 | 12 | 16 | 24 | 189 | 183 | 174 | 103 | 90 | 78 | +13 | −12 |
| 9 mg./ft.$^2$ of cyan filter | 186 | 208 | 214 | 13 | 16 | 24 | 201 | 184 | 172 | 87 | 90 | 80 | −3 | −10 |
| Processing after 6 days | | | | | | | | | | | | | | |
| 0 mg./ft.$^2$ (control) | 179 | 227 | 234 | 13 | 19 | 25 | 178 | 179 | 182 | 151 | 85 | 79 | +66 | −6 |
| 3 mg./ft.$^2$ of cyan filter | 179 | 222 | 231 | 13 | 19 | 25 | 184 | 184 | 187 | 125 | 85 | 77 | +40 | −8 |
| 6 mg./ft.$^2$ of cyan filter | 181 | 215 | 228 | 13 | 18 | 24 | 187 | 188 | 188 | 107 | 87 | 78 | +20 | −9 |
| 9 mg./ft.$^2$ of cyan filter | 189 | 219 | 234 | 14 | 18 | 24 | 208 | 194 | 193 | 88 | 86 | 78 | +2 | −8 |

EXAMPLE II

Another series of photosensitive elements were prepared in substantially the same manner as described in Example I with the exception that 0 mg./ft.$^2$ (control), 5 mg./ft.$^2$, and 15 mg./ft.$^2$ of the copper phthalocyanine filter dye were introduced into the redsensitive silver halide emulsion layer (layer No. 22) rather than the magenta dye developer layer. The photosensitive elements were exposed in a sensitometer, processed 24 hours after coating with identical diffusion transfer processing compositions and image-receiving elements, and the D log E curves plotted, all as described in Example I. FIGS. 3*a*–3*d* illustrate the D log E curves obtained from photosensitive elements containing 0 mgs., 5 mgs., 10 mgs. and 15 mgs. per square foot of cyan dye, respectively, and Table 2 below summarizes the corresponding sensitometric parameters:

TABLE 2

| | $D_{max}$ | | | $D_{min}$ | | | Slope (1.05–0.55 portion) | | | Speed (.75 int) | | | Color Balance | |
|---|---|---|---|---|---|---|---|---|---|---|---|---|---|---|
| | R | G | B | R | G | B | R | G | B | R | G | B | R | B |
| 0 mg./ft.$^2$ (control) | 199 | 202 | 192 | 14 | 15 | 23 | 194 | 187 | 157 | 150 | 156 | 151 | −6 | −5 |
| 5 mg./ft.$^2$ of cyan filter | 195 | 203 | 200 | 14 | 16 | 24 | 203 | 174 | 148 | 128 | 151 | 147 | −23 | −4 |
| 10 mg./ft.$^2$ of cyan filter | 198 | 204 | 201 | 14 | 16 | 24 | 187 | 167 | 146 | 119 | 149 | 146 | −30 | −3 |
| 15 mg./ft.$^2$ of cyan filter | 195 | 206 | 202 | 14 | 16 | 23 | 169 | 154 | 139 | 106 | 143 | 142 | −37 | −1 |

The curves of FIGS. 3*a*–3*d* considered in conjunction with the parameters of Table 2 show that an adjustment of the red color balance similar to tht shown in Example I can be accomplished in accordance with the invention by introducing varying coverages of the cyan filter dye directly into the red-sensitive silver halide layer itself. Other paramters, particularly the red slope, may be affected to a greater degree in this embodiment than when the filter material is disposed in a separate layer above the associated silver halide emulsion layer, as illustrated in Example I. A comparision of the relative position of the red curve in FIGS. 3*a*–3*d*, however, will illustrate the considerable selective red speed adjustment relative to blue and green speeds which is possible in this embodiment.

EXAMPLE III

Another series of photosensitive elements were prepared in substantially the same manner as described in Example I with the exception that 0 mg./ft.$^2$ (control), 3 mg./ft.$^2$, and 6 mg./ft.$^2$ of a yellow filter dye were introduced into the overcoat layer No. 29 of the respective elements rather than the cyan filter dye into the magenta dye developer layer. The yellow dye employed was Benzidine Yellow (Color Index Constitution No. 21095) which is commercially available, for example, from the aforementioned American Cyanamid Company under the catalog No. 45–2555.

Figure 4A:
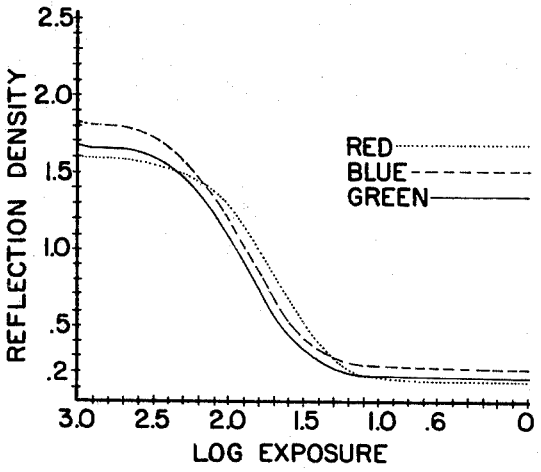
Figure 4B:
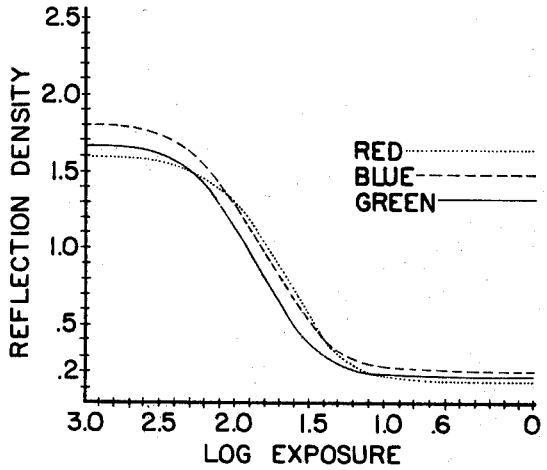
Figure 4C:
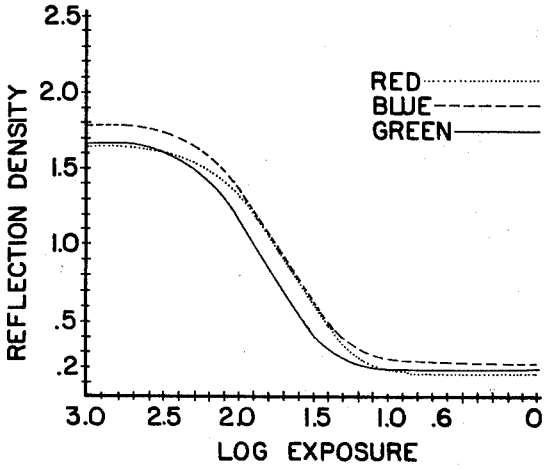

The photosensitive elements were exposed in a sensitometer, processed 24 hours after coating with identical diffusion transfer processing compositions and image-receiving elements, and the D log E curves plotted as in the previous examples. FIGS. 4*a*–4*C* illustrate the D log E curves obtained from elements containing 0 mg., 3 mgs., and 6 mgs. per square foot of yellow dye, respectively, and Table 3 below summarizes the corresponding sensitometric parameters:

TABLE 3

| | $D_{max}$ | | | $D_{min}$ | | | Slope (1.05–0.55 portion) | | | Speed (.75 int) | | | Color Balance | |
|---|---|---|---|---|---|---|---|---|---|---|---|---|---|---|
| | R | G | B | R | G | B | R | G | B | R | G | B | R | B |
| 0 mg./ft.$^2$ (control) | 160 | 169 | 184 | 14 | 16 | 21 | 161 | 167 | 163 | 163 | 178 | 172 | −15 | −6 |
| 3 mg./ft.$^2$ of yellow filter | 161 | 170 | 182 | 13 | 15 | 20 | 156 | 164 | 152 | 161 | 174 | 163 | −13 | −11 |
| 6 mg./ft.$^2$ of yellow filter | 166 | 170 | 185 | 14 | 15 | 20 | 162 | 166 | 152 | 157 | 168 | 153 | −11 | −15 |

The parameters of Table 3 and the curves of FIGS. 4*a*–4*c* illustrate the adjustment of the blue color balance by the employment of a yellow filter dye to modulate the exposure of the blue-sensitive silver halide emulsion (i.e., blue speed). It can be seen that the speeds of the other silver halide emulsions are also lowered, presumably as a result of the tail absorption of the yellow dye located above them in the blue photosensitive element; however, the lowering of the blue speed is substantially greater than the lowering of the other speeds so that the end result is a color balance shift away from blue. Again the relative position of the blue curve in the straight-line portion illustrates this effect in FIGS. 4*a*–4*c*. It should be readily apparent from the previously described manner in which the color balance parameter is determined that, if the yellow filter is selected such that the red and green speeds are each reduced an equivalent amount by tail absorption of the yellow dye, the resultant color balance shift will be exclusively along the blue axis since the algebraic difference between red and green speeds will remain the same.

It should now be understood that this invention provides an extremely advantageous means for maintaining the photographic consistency of multicolor photosensitive elements from lot to lot. The rebalancing method is one which permits the optimum and preestablished relationships of the essential image-forming components of the photosensitive element to remain relatively constant while deviations in aim color balance are conveniently corrected by varying the coverage of the introduced filter material, i.e., a component which does not enter into the image-forming process. Thus, the present invention allows the coverages and ratios of silver halide and dye components to be optimized for parameters other than color balance, such as, for example, color isolation or procesing temperature latitude, and then remain constant while the color balance is adjusted in a manner which has no effect on these optimized parameters. The method is brought about during the coating of the element as an in-process correction tool so that only a minimum of photosensitive material need be coated "out of specification" with respect to color balance Although this invention has been illustrated by the use of dye developers, it will be understood that it may advantageously be employed with other imaging systems wherein the image-forming components are initially diffusible or initially non-diffusible, and in other photographic color processes, including color negative processes, color reversal processes and silver dye bleach processes.

The silver halide emulsions associated with the filter materials of this invention may comprise any suitable light sensitive silver halide, including silver bromide, silver iodide, silver chloride, or mixed silver halides, such as silver chlorobromide, silver bromoiodide or silver chlorobrmoiodide. The emulsions may contain the various chemical sensitizers, optical sensitizers, stabilizers, speed-increasing compounds, plasticizers, hardeners, coating aids, etc., employed in the art. The binders for the silver halide salts may be gelatin or any of the various synthetic emulsion binders.

Any suitable support can be used for the photosensitive element, such as a cellulose ester, poly(ethylene terephthalate), paper, baryta coated paper, polyolefin coated paper such as polyethylene or polypropylene coated paper, etc.,, which may be electron-bombarded or otherwise treated to promote adhesion of the photographic layers.

Since certain changes may be made in the above product and process without departing from the scope of the invention herein involved, it is intended that all matter contained in the above description or shown in the accompanyng drawings shall be interpreted as illustrative and not in a limiting sense.

What is claimed is:

1. A method for the in-process correction of the color balance of a diffusion transfer multicolor photosensitive element, said element comprising a support carrying on one surface a plurality of layers including at least two silver halide emulsions of different spectral sensitivities, each emulsion having an associated dye image-providing material, said method comprising the steps of:

continuously coating on an elongated support at least two silver halide emulsions of different spectral sensitivities, each emulsion having an associated dye image-providing material;

said coating of said photosensitive element including the coating of a substantially nondiffusible nonimage-forming optical filter dye adapted to modulate the photographic color speed of at least one of said silver halide emulsions relative to the color speed of said other emulsion to provide a color balance which is a function of the optical density of said filter dye;

removing a sample portion of the coated support after a length thereof has been coated;

determining, by analysis, the diffusion transfer color balance of said sample; and thereafter continuing said coating and adjusting said color balance during said continued coating process by varying the coverage of said optical filter dye in response to the analysis of said sample by an amount sufficient to obtain a predetermined color balance.

2. A method as defined in claim 1 wherein said optical filter dye exhibits spectral absorption maxima substantially coincoding with the sensitization maxima of the silver halide emulsion whose speed is modulated threby.

3. A method as defined in claim 2 wherein the coverage of said filter dye is varied while the coverages of said silver halide emulsions and dye image-providing materials remain relatively constant.

4. A method as defined in claim 1 wherein said photosensitive element comprises, in sequence, a redsensitive silver halide layer having associated therewith a cyan dye image-providing material, a green-sensitive silver halide layer having associated therewith a magenta dye image-providing material and a blue-sensitive silver halide layer having associated therewith a yellow dye image-providing material.

5. A method as defined in claim 4 wherein a cyan filter dye is introduced into a layer overlying said red-sensitive silver halide emulsion to modulate at least the red speed.

6. A method as defined in claim 5 wherein said cyan dye is introduced into a layer intermediate said red-sensitive and green-sensitive silver halide emulsion layers.

7. A method as defined in claim 4 wherein a cyan filter dye is introduced into said red-sensitive silver halide emulsion layer to modulate at least the red speed.

8. A method as defined in claim 4 wherein a yellow filter dye is introduced into a layer overlying said blue-sensitive silver halide emulsion to modulate at least the blue speed.

9. A method as defined in claim 4 wherein a cyan filter dye is introduced into a location overlying said red-senstive silver halide and a yellow filter dye is introduced into a location overlying said blue-sensitive silver halide, thereby modulating at least both red and blue speeds simultaneously.

10. A method as defined in claim 4 wherein said cyan, magenta and yellow dye image-providing materials are dye developers contained in separate layers respectively underlying said red-sensitive, green-sensitive and blue-sensitive emulsion layers.

11. A method as defined in claim 10 wherein said filter dye is essentially the dye moiety of the dye developer associated with the silver halide emulsion whose speed is modulated thereby.

12. A method as defined in claim 10 wherein copper phthalocyanine dye is introduced iinto said magenta dye developer layer.

13. A method as defined in claim 10 wherein copper phthalocyanine dye is introduced into said redsensitive silver halide layer.

14. A method as defined in claim 10 wherein Benzidine Yellow dye is introduced into a layer overlying said blue-sensitive silver halide layer.

15. A method for the in-process correction of the color balance of a multicolor diffusion transfer photosensitive element comprising a support carrying on one surface a plurality of layers including, in sequence, a red-sensitive silver halide emulsion layer having a cyan dye developer associated therewith, a green-sensitive silver halide emulsion layer having a magenta dye developer associated therewith, said blue-sensitive silver halide emulsion layer having a yellow dye developer associated therewith; said method comprising the steps of:

continuously coating on an elongated support said silver haliide emulsions;

the coating of said photosensitive element including the coating of a quantity of a substantially nondiffusible, nonimage-forming optical filter dye exhibiting spectral absorption maxima substantially coinciding with the sensitization maxima of at least one of said silver halide emulsions and adapted to modulate the photographic color speed of said silver halide emulsion relative to the color speeds of said other emulsions to provide a color balance which is a function of the coverage of said filter dye;

removing a sample portion of the coated support after a length thereof has been coated;

determining, by analysis, the diffusion transfer color balance of said sample; and thereafter continuing said coating and adjusting the coverage of said filter dye during said continuing coating process to an amount sufficient to obtain a predetermined color balance in response to the analysis of said sample.

16. A method as defined in claim 15 wherein the coverage of said filter dye is varied while the coverages of said silver halide emulsions and dye developers remain relatively constant.

17. A method as defined in claim 15 wherein said filter dye is essentially the dye moiety of the dye developer associated with the silver halide emulsion whose speed is being modulated thereby.

18. A method as defined in claim 15 wherein said cyan, magenta and yellow dye developers are contained in separate layers respectively underlying said red-sensitive, green-sensitive and blue-sensitive silver halide emulsion layers.

19. A method as defined in claim 18 wherein a cyan dye is introduced into a layer overlying said red-sensitive silver halide emulsion layer to modulate at least the red speed.

20. A method as defined in claim 19 whrein a cyan dye is introduced into said magenta dye developer layer.

21. A method as defined in claim 18 wherein a cyan dye is introduced into said red-sensitive silver halide emulsion layer.

22. A method as defined in claim 18 wherein a yellow dye is introduced into a layer overlying said bluesensitive silver halide emulsion layer to modulate at least the blue speed.

23. A method for the in-process correction of the color balance of a multicolor diffusion transfer photosensitive element, said method comprising the steps of continuously coating on one surface of an elongated support a plurality of layers comprising, in sequence, a layer including a cyan dye developer, a red-sensitive silver halide emulsion layer, a layer including a magenta dye developer, a green-sensitive silver halide emulsion layer, a layer including a yellow dye developer and a blue-sensitive silver halide emulsion layer; comprising the steps of:

said coating including the coating of a quantity of a substantially nondiffusible, nonimage-forming cyan filter dye in said magenta dye developer layer to provide means for modulating the exposure of said redsensitive silver halide emulsion without affecting the exposure of said other emulsion, said means providing a red color balance which is a function of the coverage of said cyan filter dye;

removing a sample portion of the coated support after a length thereof has been coated;

determining, by analysis, the diffusion transfer color balance of said sample; and thereafter continuing said coating and adjusting the coverage of said cyan filter dye during said continued coating process to an amount sufficient to obtain a different predetermined red color balance in response to the analysis of the sample while maintaining the coverges of said silver halide emulsions and said dye developers relatively constant.

* * * * *